US008795436B2

(12) United States Patent
Yanagawa

(10) Patent No.: US 8,795,436 B2
(45) Date of Patent: Aug. 5, 2014

(54) CLEANING AND DRYING METHOD AND APPARATUS

(75) Inventor: Keita Yanagawa, Anjo (JP)

(73) Assignee: Denso Corporation, Kariya (JP)

( * ) Notice: Subject to any disclaimer, the term of this patent is extended or adjusted under 35 U.S.C. 154(b) by 377 days.

(21) Appl. No.: 13/184,922

(22) Filed: Jul. 18, 2011

(65) Prior Publication Data

US 2012/0017946 A1 Jan. 26, 2012

(30) Foreign Application Priority Data

Jul. 22, 2010 (JP) ..... 2010-165058
Jul. 30, 2010 (JP) ..... 2010-171727

(51) Int. Cl.

| | |
|---|---|
| ***B08B 3/00*** | (2006.01) |
| ***B08B 7/04*** | (2006.01) |
| ***F26B 3/04*** | (2006.01) |
| ***B08B 3/14*** | (2006.01) |
| ***B08B 3/02*** | (2006.01) |

(52) U.S. Cl.

CPC ... *F26B 3/04* (2013.01); *B08B 3/14* (2013.01); *B08B 3/022* (2013.01); *B08B 2230/01* (2013.01)

USPC ..... 134/10; 134/11; 134/12; 134/19; 134/21; 134/30; 134/31; 134/32; 134/37

(58) Field of Classification Search

CPC ..... B08B 3/022; B08B 2230/01; B08B 3/14; F26B 3/04

USPC ..... 134/10, 11, 12, 19, 21, 30, 31, 37, 32

See application file for complete search history.

(56) References Cited

U.S. PATENT DOCUMENTS

2003/0205240 A1* 11/2003 Bergman ..... 134/3
2011/0100400 A1 5/2011 Ostervold et al.

FOREIGN PATENT DOCUMENTS

| | | |
|---|---|---|
| JP | B2-62-048756 | 10/1987 |
| JP | A-63-194787 | 8/1988 |
| JP | A-07-308642 | 11/1995 |
| JP | A-2000-325893 | 11/2000 |
| JP | A-2002-110591 | 4/2002 |
| JP | A-2005-195568 | 7/2005 |
| JP | A-2006-231273 | 9/2006 |
| JP | A-2009-006241 | 1/2009 |
| JP | A-2011-016079 | 1/2011 |
| JP | A-2011-228385 | 11/2011 |
| WO | WO 2009/044530 A1 | 4/2009 |
| WO | WO 2009/142506 A1 | 11/2009 |

OTHER PUBLICATIONS

Apr. 24, 2012 Japanese Office Action issued in Japanese Patent Application No. 2010-165058 (with translation).
Jun. 5, 2013 Office Action issued in Chinese Application No. 201110206582.5 (with translation).
Jul. 3, 2012 Office Action issued in Japanese Patent Application No. 2010-171727 (with translation).

* cited by examiner

*Primary Examiner* — Alexander Markoff
(74) *Attorney, Agent, or Firm* — Oliff PLC

(57) ABSTRACT

A cleaning liquid is pressurized and superheated to a condition, in which temperature of the cleaning liquid is above an atmospheric boiling point. A product to be cleaned is interposed between a pair of liquid holding blocks, so that gaps are respectively formed between side surfaces of the product and the liquid holding blocks. The pressurized and superheated liquid is injected to the product so that layers of condensate of vapor of injected cleaning liquid are formed in the gaps. Contamination on the surface of the product is removed by the cleaning liquid and the surface is dried by latent heat of the condensate of the vapor of the cleaning liquid.

7 Claims, 7 Drawing Sheets

CLEANING AND DRYING METHOD AND APPARATUS

CROSS REFERENCE TO RELATED APPLICATION

This application is based on Japanese Patent Applications No. 2010-165058 filed on Jul. 22, 2010 and No. 2010-171727 filed on Jul. 30, 2010, the disclosures of which are incorporated herein by reference.

FIELD OF THE INVENTION

The present invention relates to a cleaning and drying method and apparatus for a product to be cleaned, in particular relates to a cleaning and drying method and apparatus for a surface-treated product for which a surface treatment, such as plating, chemical conversion treatment, and so on, is done.

The present invention further relates to a cleaning and drying method and apparatus for a product to be cleaned, according to which cleaning liquid (lyophobic to oil) is injected to the product in a pressurized and superheated condition (temperature of the cleaning liquid is higher than a boiling point of atmospheric pressure), so that removal of contamination and dry-out of the product can be carried out in the same process.

BACKGROUND OF THE INVENTION

In a surface treatment, such as plating, chemical conversion treatment and soon, a cleaning process is conventionally carried out. For example, a rinsing process is carried out for removing drug solution from a surface-treated product by multi-stage water washing of maceration and/or shower of water. In the water washing process for the surface treatment, the drug solution adhered to the product is diluted and removed. Therefore, not only a large volume of water is necessary but also wastewater treatment is required.

It is, therefore, proposed in a conventional cleaning method to increase a number of water washing tanks so as to suppress the volume of the washing water. Alternatively, as disclosed in Japanese Examined publication No. S62-48756, it is proposed to provide a reduced-pressure distillation device in order to achieve no wastewater.

The inventor of the present invention has proposed ideas (not published before the present invention) in a prior Japanese Patent Application No. 2009-162797 (published under Publication No. 2011-016079) and in another prior Japanese Patent Application No. 2010-094897 (not yet published). In the above prior Patent Applications, the inventor proposed a cleaning and drying method and apparatus, according to which cleaning fluid (in a pressurized and superheated condition) is injected to a product to be cleaned so that a cleaning and drying process can be carried out in a shorter time period.

According to the above prior art (JP S62-48756), since the reduced-pressure distillation device is provided to achieve no wastewater, it is a problem that a cost for the apparatus is increased or the apparatus may become larger.

According to the prior Patent Applications by the same inventor (not belonging to the prior arts), it is possible to clean and dry the product in a shorter time period by injecting the cleaning fluid of the pressurized and superheated condition. This is effective for a physical cleaning method to remove fats and oils or extraneous material adhered to the product (such as, electronic parts and components, mechanical parts and components). However, it is not possible to achieve cleaning quality, which is required for water washing for a surface-treated product.

The inventor of the present invention proposed a small-sized cleaning apparatus in the above prior application (application No. 2010-094897), which is not published at the date of application of the present invention.

According to the cleaning apparatus of the above prior application, cleaning liquid is pressurized and injected into a cleaning and drying chamber covering a product to be cleaned. A boiling point of the cleaning liquid in the atmospheric pressure is remarkably changed in a pressurized condition. And the cleaning liquid is lyophobic to oils (insoluble in fats and oils) and selected from such liquids, as water, hydrated alcohol, fluorine compound (for example, hydrofluoric carbon (HFC), hydrofluoric ether (HFE)) and so on, wherein the boiling point thereof (saturation temperature) is higher than 40° C. in the atmospheric pressure.

The injected cleaning liquid (which is pressurized and superheated) is instantaneously vaporized and expanded on a surface of the product to be cleaned, in order to remove contamination and/or fats and oils from the surface of the product by actions of flow speed and heat energy of the cleaning liquid by expansion. Since molecules of the injected cleaning liquid are lyophobic to fats and oils, collision force generated by the vaporization and expansion acts as repulsive force to thereby work on removing the fats and oils.

In addition, volume of the vapor of the cleaning liquid injected into the cleaning and drying chamber (in the atmospheric pressure) is larger than a space volume of the cleaning and drying chamber, so that the effect for wiping out and removing the Fats and oils can be increased.

FIG. 15 is a schematic view showing a cleaning and drying apparatus of the prior application. The cleaning and drying apparatus will be explained as a related art. In FIG. 15, a product 1 to be cleaned, to which fats and oils are adhered, is transferred by a conveyer 2 to a cleaning and drying position. A tank 5 for pooling cleaning liquid 4 is provided in the cleaning and drying apparatus.

In the tank 5, the cleaning liquid 4 is pooled, a boiling point of which is remarkably changed in the atmospheric pressure and in a pressurized condition. The cleaning liquid is lyophobic to oils (insoluble in fats and oils) and selected from such liquids, as water, hydrated alcohol, fluorine compound (for example, hydrofluoric carbon (HFC), hydrofluoric ether (HFE)) and so on, wherein the boiling point thereof (saturation temperature) is higher than 40° C. in the atmospheric pressure.

The cleaning liquid 4 from the tank 5 is pressurized by a liquid pump 6 and supplied to an injection nozzle 3 via a fluid supply pipe 7. A heat exchanger 8 is provided at an intermediate point of the fluid supply pipe 7, so that the cleaning liquid is heated to a condition of superheated cleaning liquid, the temperature of which is higher than the boiling point (the saturation temperature) in the atmospheric pressure, more preferably, the temperature of which is close to a boiling point of such a pressurized condition.

The cleaning and drying process is carried out at the same time, by injecting the pressurized and superheated cleaning liquid 4 from the injection nozzle 3 to the product 1 to be cleaned, which is located in the atmospheric pressure. A cleaning and drying chamber 10 is provided for covering the product 1. A vapor collecting opening 13 is provided at a downward side of the chamber 10, so that the vapor of the cleaning liquid 4 injected from the injection nozzle 3 can be collected. A volume of the cleaning liquid injected from the injection nozzle into the cleaning and drying chamber 10 in the atmospheric pressure is made larger than a space volume of the cleaning and drying chamber 10.

The cleaning liquid 4 injected from the injection nozzle 3 and the contamination removed from the product 1 are collected in the tank 5. When continuously repeating the cleaning and drying process, the contamination from the products 1 will be accumulated in the tank 5.

The contamination (fats and oils) accumulated in the tank 5 are not dissolved in the cleaning liquid, those fats and oils come to the surface in the tank 5, when specific gravity of those fats and oils is smaller than that of the cleaning liquid. As a result, the fats and oils form a layer at the surface, while the cleaning liquid 4 remains in the lower portion in the tank 5. Therefore, the tank 5 has a function for separating the fats and oils from the cleaning liquid. The fats and oils at the surface layer are discharged through a drain pipe 24, so that the contamination accumulated in the tank 5 is finally discharged from the tank 5.

According to the cleaning and drying method and apparatus of the above prior application, the cleaning liquid 4, such as the water, the hydrated alcohol and so on, the boiling point of the atmospheric pressure (the saturation temperature) of which is higher than that of the fluorine compound, the vapor of the cleaning liquid hardly condenses on the surface of the product to be cleaned. At a portion of the surface, at which a layer of the condensate is formed, effect for removing the fats and oils may be decreased and the cleaning liquid 4 may remain on the surface (that is, it may cause an insufficient drying process).

On the other hand, when the fluorine compound, the boiling point of the atmospheric pressure (the saturation temperature) is lower than that of the water, is used, the vapor pressure is high and the layer of the condensate is hardly formed compared with the water. Therefore, even when the layer of the condensate is formed, the condensate is easily vaporized under the atmospheric pressure. Although not causing the insufficient drying, global warming material may be discharged into the air. It is, therefore, necessary to surely collect the vapor of the cleaning liquid 4.

According to the cleaning and drying apparatus of the prior application (the related art), it is difficult for the vapor collecting opening 13 to completely collect the vapor of the cleaning liquid 4 injected from the injection nozzle. In addition, the vapor of the cleaning liquid 4 easily condenses. Therefore, the effect for removing the fats and oils is decreased at the portion, at which the condensate is formed. Furthermore, the insufficient drying may be caused when the cleaning liquid 4 remains on the surface of the product to be cleaned. Furthermore, it may have a problem that the global warming material (the fluorine compound) may be discharged into the air.

SUMMARY OF THE INVENTION

The present invention is made in view of the above problems. It is an object of the present invention to provide a cleaning and drying method and apparatus, according to which large volume of cleaning fluid is not used in a rinsing process for the product to be cleaned, the product can be cleaned and dried in a simple structure, and the cleaning and drying processes can be carried out at the same time.

It is another object of the present invention to provide a cleaning and drying method and apparatus, according to which the cleaning liquid can be repeatedly used (re-used), the effect for removing fats and oils as well as contamination may not be decreased, remanence of the cleaning liquid can be avoided, and the global warming material may not be discharged into the air.

According to a feature of the invention, for example, as defined in the claim 1, a cleaning and drying method has a step of arranging a product to be cleaned in a liquid holding member with a gap between the product and the liquid holding member; a step of pressurizing and superheating cleaning liquid to a condition of superheated liquid above boiling point in the atmospheric pressure; a step of injecting the superheated liquid to the product so that condensate of the cleaning liquid is held in the gap; a step of cleaning the product by continuously carrying out injection of the cleaning liquid of the above step, so that contamination and/or drug solution adhered to the product is removed; and a step of drying the product by latent heat of the condensation of the cleaning liquid.

According to the above feature of the invention, the cleaning liquid is kept in such pressurized and superheated condition that temperature thereof is above the boiling point in the atmospheric pressure, and such cleaning liquid is injected. The condensate of the cleaning liquid is held in the gap between the product and the liquid holding member so as to remove the contamination and/or drug solution adhered to the product. As a result, the chemical cleaning time, in which metal ion or the contamination may be dissolved into the condensate held in the gap between the product and the liquid holding member, becomes longer to thereby increase detergency. In addition, since the condensation of the vapor of the cleaning liquid is continuously done in the gap, it is possible to heat the product by the heat of condensation. Accordingly, it is possible to smoothly dry the product after the end of the injection of the cleaning liquid. As a result of increasing the detergency, it becomes possible to avoid the use of the large volume of the cleaning liquid. The cleaning and drying method, according to which the cleaning and the drying are carried out at the same time, can be obtained.

According to another feature of the invention, for example, as defined in the claim 5, a cleaning and drying apparatus has:

an injection device for injecting cleaning liquid to a product to be cleaned, wherein the cleaning liquid is pressurized and superheated to a condition in which temperature of the cleaning liquid is above a boiling point in the atmospheric pressure;

a liquid holding member forming a gap with the product for holding condensate of the cleaning liquid injected from the injection device in the gap; and a drying device for holding the product in the air and drying the product by latent heat of the condensation of the cleaning liquid.

According to the above feature, the liquid holding member is arranged adjacent to the product to be cleaned and thereby the condensate of the cleaning liquid is held in the gap between the surface of the product and the liquid holding member. The cleaning liquid in the pressurized and superheated condition, which corresponds to such a condition that the temperature is higher than the atmospheric boiling point, is continuously injected into the gap, so that the condensate is continuously generated. As a result, physical detergent action (by collision of the cleaning liquid against the product to be cleaned) as well as chemical detergent action (by holding the cleaning liquid in the gap) can be achieved. Therefore, a high level of cleaning quality is achieved by the cleaning and drying apparatus of the invention.

According to a further feature of the present invention, for example, as defined in the claim 8, a cleaning and drying method has the following steps:

a step of pressurizing and superheating cleaning liquid to a condition that temperature thereof is higher than an atmospheric boiling point;

a step of injecting the pressurized and superheated cleaning liquid into a cleaning and drying chamber of a cleaning and drying container, in which a product to be cleaned is arranged, the injected cleaning liquid being changed to vapor when injected;

a step of sucking the vapor of the cleaning liquid, which is injected into the cleaning and drying chamber, into a suction port of a suction device via a vapor discharging container having a vapor collecting opening, wherein the vapor discharging container is provided adjacent to the cleaning and drying container; and a step of re-using the vapor of the cleaning liquid which is sucked into the suction port as the cleaning liquid.

According to the above feature, the cleaning liquid is converted to the pressurized and superheated condition and such cleaning liquid is injected into the cleaning and drying chamber, the vapor of the cleaning liquid injected into the cleaning and drying chamber is sucked into the suction port of the suction device via the vapor collecting opening, and the collected cleaning liquid is re-used. The condensate condensed from the vapor of the pressurized and superheated cleaning liquid is not easily formed on the surface of the product. Therefore, the effect for removing the fats and oils from the product is not decreased. In addition, the condensate does not remain on the surface of the product, so as to avoid the insufficient drying process. Even when the global warming material is used as the cleaning liquid, such material is not discharged into the air, because the vapor of the cleaning liquid is sucked into the suction port and the collected cleaning liquid is re-used.

According to a still further feature of the invention, for example, as defined in the claim 14, a cleaning and drying apparatus has the following components:

a tank for pooling cleaning liquid;

a cleaning and drying container for accommodating a product to be cleaned;

a pressurizing and superheating device for pressurizing and superheating a part of the cleaning liquid from the tank to such a condition that temperature of the cleaning liquid is higher than an atmospheric boiling point;

an injection device for injecting the pressurized and superheated cleaning liquid toward the product arranged in a cleaning and drying chamber of the cleaning and drying container, the injected cleaning liquid being converted into vapor when injected;

a vapor discharging container, which is provided adjacent to the cleaning and drying container and has a vapor collecting opening communicated to the cleaning and drying chamber; and a suction device having a suction port connected to the vapor discharging container for sucking the vapor of the cleaning liquid injected into the cleaning and drying chamber via the suction port in order to collect the cleaning liquid in the tank.

According to the above feature, the cleaning liquid is converted to the pressurized and superheated condition and such cleaning liquid is injected into the cleaning and drying chamber, the vapor of the cleaning liquid injected into the cleaning and drying chamber is sucked into the suction port of the suction device via the vapor collecting opening, and the collected cleaning liquid is re-used. The condensate condensed from the vapor of the pressurized and superheated cleaning liquid is not easily formed on the surface of the product. Therefore, the effect for removing the fats and oils from the product is not decreased. In addition, the condensate does not remain on the surface of the product, so as to avoid the insufficient drying process. Even when the global warming material is used as the cleaning liquid, such material is not discharged into the air, because the vapor of the cleaning liquid is sucked into the suction port and the collected cleaning liquid is re-used.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

Figure 1:
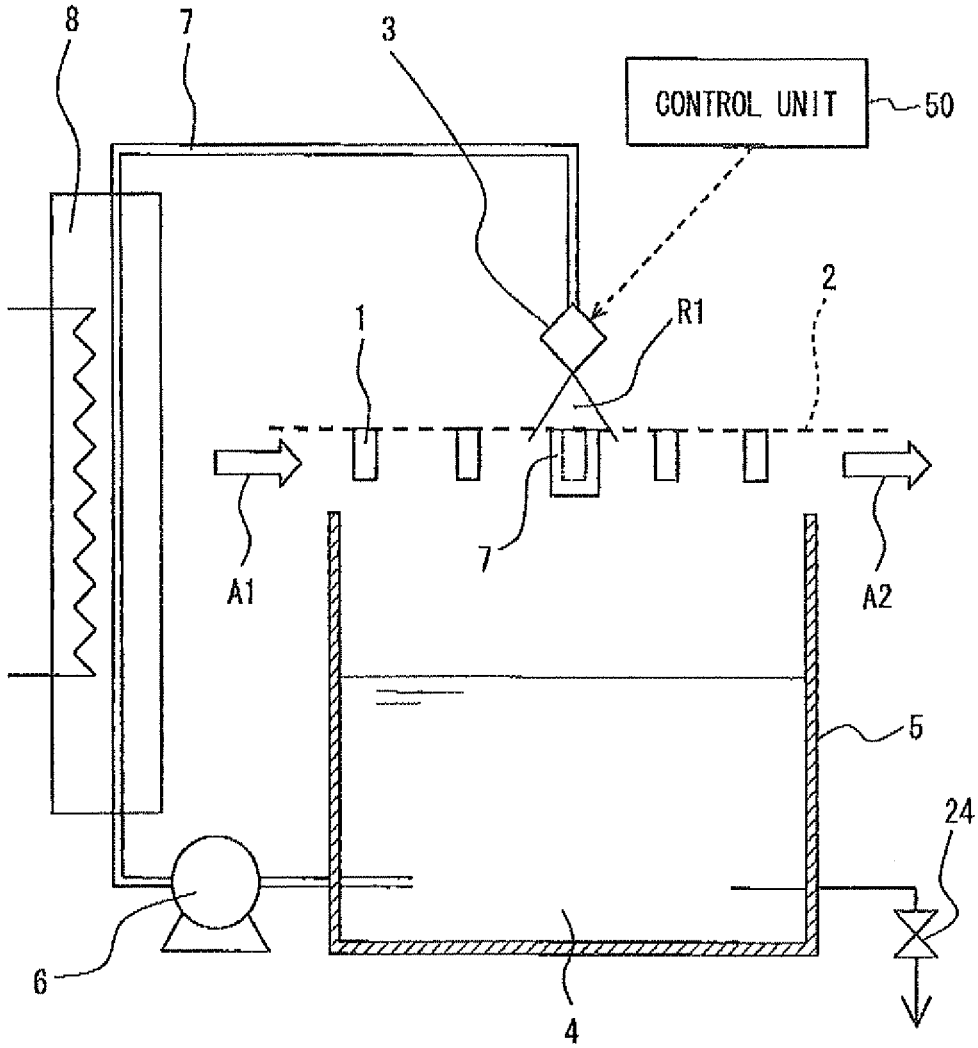
FIG. 1 is a schematic view showing a whole structure of a cleaning and drying apparatus for a surface-treated product according to a first embodiment of the present invention.

The present invention will be explained by way of multiple embodiments with reference to the drawings. The same reference numerals are given to the same or similar parts and/or portions through the embodiments so as to omit the repeated explanation thereof.

First Embodiment

Figure 2:
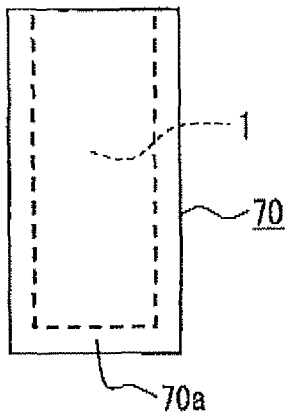
FIG. 2 is a schematic front view showing a liquid holding member.
Figure 3:
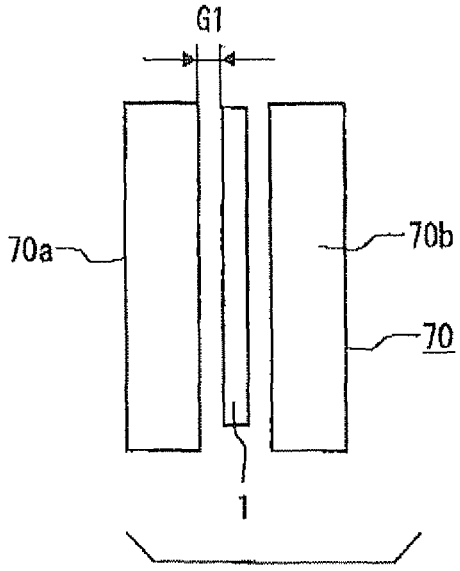
FIG. 3 is a schematic side view showing the liquid holding member.
Figure 4:
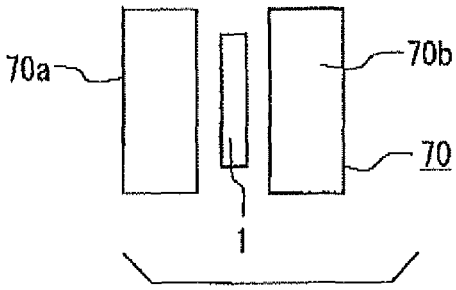
FIG. 4 is a schematic top plane view showing the liquid holding member.

A first embodiment of the present invention will be explained with reference to FIGS. 1 to 5. FIG. 1 is a drawing showing a whole structure of a cleaning and drying apparatus for a surface-treated product. FIG. 2 is a front view showing a liquid holding member (a liquid holding block). FIG. 3 is a side view showing the liquid holding member and a surface-treated product, which will be cleaned. FIG. 4 is a top plane view showing the liquid holding member.

In FIG. 1, a surface-treated product 1, which is made of a metal plate member forming an electrical terminal for an electrical part and which corresponds to a product to be cleaned, is gripped by a hanger type conveyer 2 and continuously carried from a left to a right hand side of FIG. 1 in a direction indicated by arrows A1 and A2. The conveyer 2 has a function of not only carrying the products but also holding the product 1 in the air after injection by an injection nozzle 3 is done and drying the same by heat of condensation of condensate.

The product 1 to be cleaned, to which drug solution for surface treatment is adhered, is transferred by the conveyer 2 to a cleaning and drying position in a sequential order. A tank 5 for pooling cleaning liquid 4 is provided at the cleaning and drying position. Water or hydrated alcohol for cleaning liquid 4 is pooled in the tank 5.

The cleaning liquid 4 is supplied from the tank 5 to the injection nozzle 3 by a liquid pump 6 (a pressurizing means) via a supply pipe 7, so that the cleaning liquid 4 is injected from the injection nozzle 3.

A heat exchanger 8 is provided at an intermediate portion of the supply pipe 7 as a heating device for heating the cleaning liquid 4 to a condition of pressurized and superheated liquid above an atmospheric boiling point (saturation temperature) of the cleaning liquid 4, or more preferably to a condition of pressurized and superheated liquid around the boiling point in the pressurized condition. The pressurized and superheated liquid 4 is injected from the injection nozzle 3 to the product 1 to be cleaned, which is located in the atmospheric pressure.

A condensate holding block (a liquid holding member 70) is provided at the cleaning and drying position adjacent to the product 1 to be cleaned. The liquid holding member 70 is composed of a pair of metal plates, a thickness of which is 10 mm. An example of a structure for the liquid holding member 70 is shown in FIGS. 2 to 4. FIG. 2 is the front view showing the liquid holding member 70. In FIG. 2, the product 1 to be cleaned is indicated by a dotted line and arranged behind the liquid holding member 70. The liquid holding member 70 covers the product 1 to be cleaned by at least in three directions.

FIG. 3 shows the pair of the metal plates 70*a* and 70*b* of the liquid holding member 70 as well as the product 1 to be cleaned, when viewed from a right-hand side. FIG. 4 is the top plane view likewise showing the pair of the metal plates 70*a* and 70*b* of the liquid holding member 70 as well as the product 1 to be cleaned. As shown in FIG. 3, the product 1 of a plate shape to be cleaned is arranged between the pair of the metal plates 70*a* and 70*b* with a gap G1, respectively between the product 1 and the metal plate 70*a* and 70*b*. The gap G1 is set at such a value, with which the cleaning liquid can be held in the gap G1 by surface tension. According to such a structure, a sufficient amount of the cleaning liquid is held on the surfaces of the product 1 until the cleaning liquid is dried up from the surfaces. As a result, a chemical cleaning time becomes longer to improve detergency.

The water or hydrated alcohol is pressurized by the liquid pump 6 (FIG. 1), superheated by the heat exchanger 8 (the heating device) to the condition of the pressurized and superheated liquid the temperature of which is above the atmospheric boiling point (the saturation temperature), or more preferably to the condition of the pressurized and superheated liquid the temperature of which is around the boiling point of the pressurized condition.

The pressurized and superheated liquid is supplied to the injection nozzle 3 via the supply pipe 7 and injected from the injection nozzle 3 toward the product 1, which is located in the atmospheric pressure. R1 in FIG. 1 indicates an area of such injection of the cleaning liquid 4. The injection area R1 covers outer walls of the liquid holding member 70. A reference numeral 24 designates a drain valve.

The cleaning liquid 4 is injected from the injection nozzle 3 so that the cleaning liquid directly enters the gaps G1 in a longitudinal direction of the Gap G1 (an up-down direction in FIG. 3). According to such injection, speed of the cleaning liquid passing through the gaps G1 can be increased and the cleaning liquid collides with contamination and/or drug solution at high speed. As a result, physical cleaning property can be increased.

Figure 5:
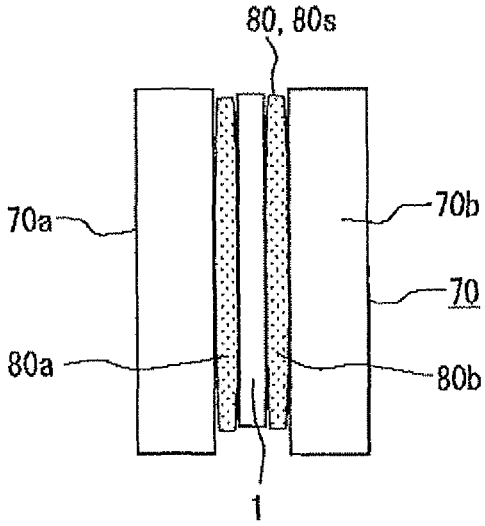
FIG. 5 is a schematic side view showing the liquid holding member in which a layer of condensate is formed.

The cleaning liquid 4 injected from the injection nozzle 3 is instantaneously vaporized and expanded. Such expanded steam passes through the gaps G1 between the product 1 and the liquid holding member 70, to thereby form liquid holding layers 80*s* of condensate 80 as shown in FIG. 5. The condensate at both sides of the product 1 is respectively indicated by reference numerals 80*a* and 80*b*. FIG. 5 is a side view, when viewed from a right-hand side, showing the liquid holding member 70 in which the liquid holding layer 80*s* (the layer of the condensate 80) is formed in the first embodiment.

The liquid holding member 70 is made of metal having high heat conduction. As shown in FIG. 3, side surfaces of the product 1 face to the liquid holding member 70 via the gaps G1, so that the contamination and/or drug solution can be removed from the side surfaces. The gaps G1 are formed as having a distance of about 1.0 mm, so that the condensate 80 can be held in the gaps G1 by the surface tension (as shown in FIG. 5).

Injection timing as well as injection time of the injection nozzle 3 (FIG. 1) is controlled by electrical signals from an electronic control unit 50 (a cleaning process control device), so that the injection of the cleaning liquid 4 from the injection nozzle 3 is carried out for a predetermined time in order to remove the contamination and/or drug solution which are adhered to the product 1.

Cleaning Process of First Embodiment

A cleaning process will be explained. When a surface treatment for the product 1 is finished, the product 1 to which the drug solution is adhered is gripped by the hanger-type conveyer 2 and continuously carried from the left to the right hand side of FIG. 1 in the direction indicated by the arrows A1 and A2. The product 1 to be cleaned is transferred by the conveyer 2 to the cleaning and drying position in the sequential order, at which the tank 5 for pooling the cleaning liquid 4 as well as the injection nozzle 3 is provided.

The liquid pump 6 is operated so as to pressurize and supply the cleaning liquid 4 from the tank 5 to the injection nozzle 3 through the supply pipe 7. The cleaning liquid 4 is superheated by the heat exchanger 8 (the heating device) provided at the intermediate point of the supply pipe 7. The cleaning liquid 4 is pressurized and superheated to the condition of the pressurized and superheated liquid, the temperature of which is above the atmospheric boiling point (the saturation temperature) of the cleaning liquid, or more preferably to the condition of the pressurized and superheated liquid, the temperature of which is around the boiling point of the pressurized condition.

For example, the pressurized pressure is 0.3 MPa and the heated temperature is 130° C. The pressurized and superheated liquid is injected from the injection nozzle 3 in the injection area R1 at a predetermined spreading angle toward the product 1, which is located in the atmospheric pressure. The injected liquid is vaporized and expanded instantaneously and/or when the liquid reached at the surfaces of the product 1. The contamination as well as the drug solution adhered to the surfaces of the product 1 is wiped out (removed) at once by energy of such expansion.

As shown in FIG. 5, the layers of the condensate 80*a* and 80*b* are formed on the surfaces of the product 1 by saturated vapor, which is a part of the pressurized and superheated liquid which has been vaporized and expanded. More exactly, the liquid holding layer 80*s* of the condensate 80*a* is formed in the gap G1 between the liquid holding member 70*a* and the product 1, while the liquid layer 80*s* of the condensate 80*b* is formed in the gap G1 between the liquid holding member 70*b* and the product 1. Water amount of the condensate 80*a* and 80*b* is increased by the continuous injection of the pressurized and superheated liquid.

When the water amount of the condensate is increased, the condensate 80*a* and 80*b* flows on the surfaces of the product 1 in a gravity direction. However, the liquid holding member 70 (the metal plates 70*a* and 70*b*) holds a certain amount of the condensate 80*a* and 80*b* on the surfaces of the product 1 by the surface tension. As a result, the liquid holding layer 80*s* is continuously formed between the surfaces of the liquid holding member 70 and the product 1.

According to the continuous injection of the pressurized and superheated liquid, fresh condensate 80*a* and 80*b* is added to the liquid holding layer 80*s*. As a result, the drug solution locally adhered to the surfaces of the product 1 can be rinsed away by the liquid holding layer 80*s*, which can be regarded as a liquid holding tank floating in the air. In a rinsing process, chemical detergent action, for example, ionized material is dissolved in the water, is brought out.

When a predetermined time (for example, about one minute) has passed off after the continuous injection of the pressurized and superheated liquid, temperature at the surfaces of the product 1 as well as temperature of condensate 80*a* and 80*b* of the liquid holding layer 80*s* is increased by latent heat of the condensation. Due to the temperature increase, the condensate 80*a* and 80*b* disappears from the surfaces of the product 1 after the end of the injection. Finally, the surfaces of the product 1 will be dried and the product 1 is transferred to a next process by the conveyer 2.

Second Embodiment

A second embodiment of the present invention will be explained. Different portions from the first embodiment will be explained. Although in the first embodiment, the surface of the liquid holding member 70 is flat, a concavo-convex surface is formed on the surfaces of the liquid holding member 70 according to the second embodiment.

Figure 6:
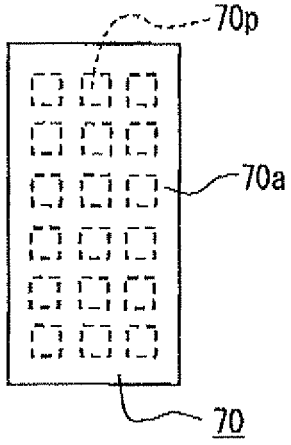
FIG. 6 is a schematic front view showing a liquid holding member (a liquid holding block) according to a second embodiment of the present invention.
Figure 7:
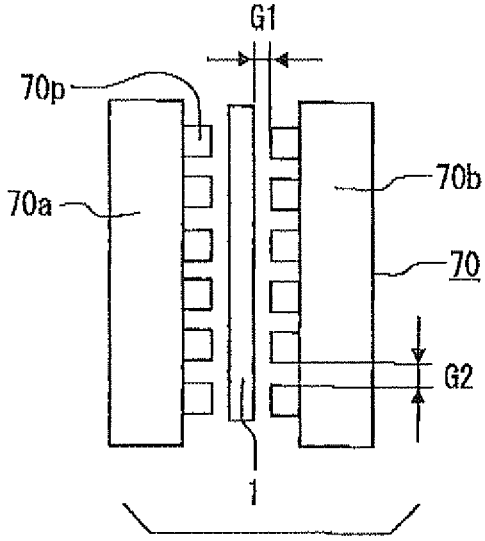
FIG. 7 is a schematic side view showing the liquid holding member.
Figure 8:
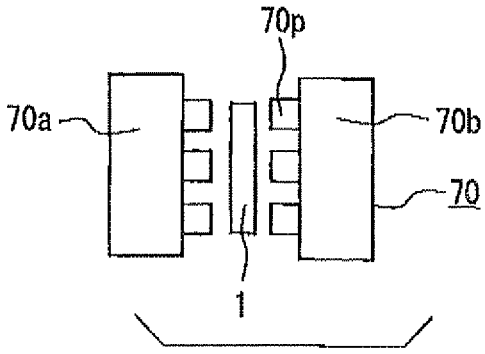
FIG. 8 is a schematic top plane view showing the liquid holding member.

FIG. 6 is a front view showing a liquid holding block forming the liquid holding member 70 according to the second embodiment. FIG. 7 is a side view showing the liquid holding member 70 of FIG. 6, when viewed from aright hand side. FIG. 8 is a top plane view showing the liquid holding member 70 of FIG. 6. In FIG. 7, the liquid holding member 70 is made of metal having high heat conduction. Each of the liquid holding blocks 70*a* and 70*b* faces to the side surfaces of the product 1 via the respective gaps G1.

The gap G1 has a distance of about 1.0 mm, so that the condensate (corresponding to the condensate 80 of FIG. 5) can be held in the gaps G1 by the surface tension. As shown in FIG. 7, convex portions are separated from each other by gaps G2, which is also equal to about 1.0 mm. For example, a punching plate 70*p*, in which multiple openings are punched out, is attached to the surface of the respective block of the liquid holding member 70, so that the concavo-convex surface is formed. The concavo-convex surface of the liquid holding member 70 may be also formed by a forging process.

Third Embodiment

Figure 9:
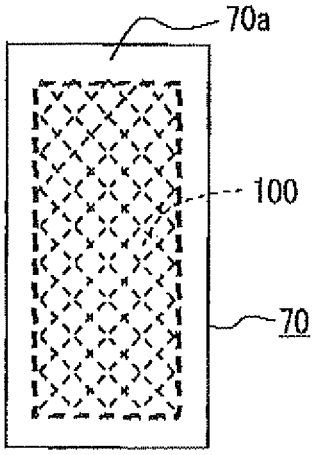
FIG. 9 is a schematic front view showing a liquid holding member according to a third embodiment of the present invention.

A third embodiment of the present invention will be explained. FIG. 9 is a front view showing a liquid holding block forming the liquid holding member 70 according to the third embodiment. A different point from the above embodiment will be explained. According to the second embodiment, the punching plate is used. According to the third embodiment, a concavo-convex forming member 100, such as a checkered plate or a wire netting, is attached to each of the surfaces of the liquid holding member 70, so that a concavo-convex surface or a porous surface is formed on the surfaces of the liquid holding member 70. With such concavo-convex forming member 100 attached to the surfaces of the liquid holding member 70, it is possible to increase capability of liquid-holding of the condensate 80.

Fourth Embodiment

Figure 10:
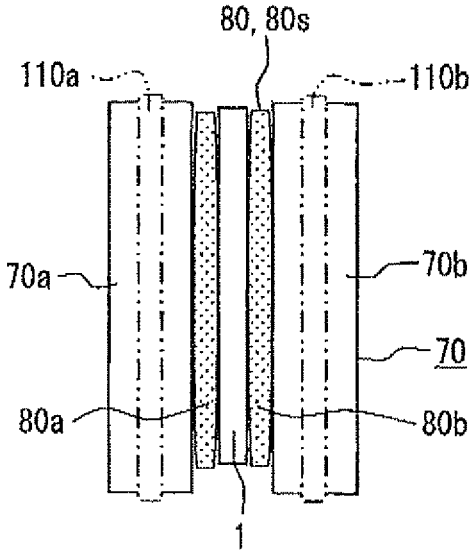
FIG. 10 is a schematic side view showing a liquid holding member according to a fourth embodiment of the present invention, in which a Peltier element is provided.

A fourth embodiment of the present invention will be explained. A different point from the above embodiment will be explained. FIG. 10 is a schematic side view showing the liquid holding member 70 according to the fourth embodiment, in which Peltier element is provided. According to the above embodiments, the metal plate is used as the liquid holding member 70. According to the fourth embodiment, however, as shown in FIG. 10, Peltier elements 110*a* and 110*b* are used for actively cooling down the liquid holding member 70, to thereby facilitate the liquid-holding of the condensate 80. The Peltier element is a semiconductor element using Peltier effect, according to which when electric current is supplied to a junction of two different metals, heat is transferred from one metal to the other metal.

Figure 11:
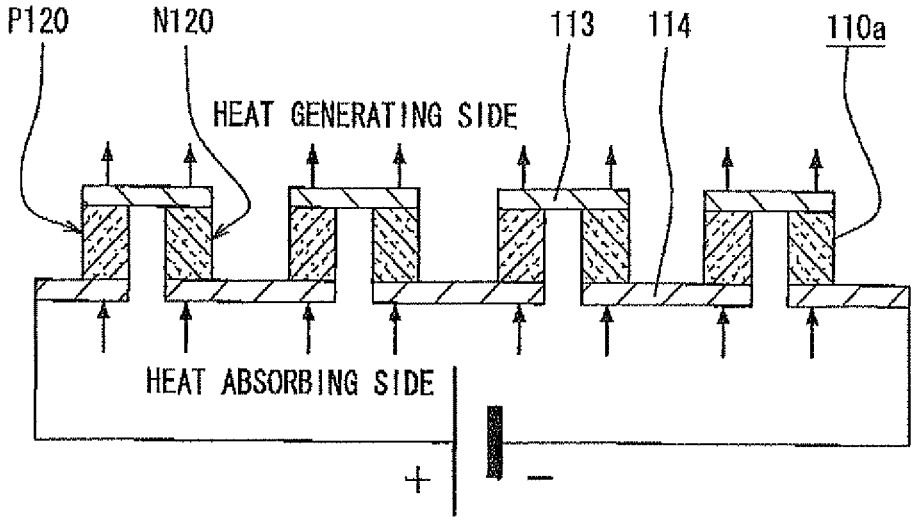
FIG. 11 is an explanatory view for explaining principle of operation of the Peltier element in the fourth embodiment.

The Peltier elements 110*a* and 110*b* are respectively arranged at an intermediate portion of the liquid holding blocks 70*a* and 70*b*. FIG. 11 is an explanatory view for explaining principle of operation of one of the Peltier elements 110*a* and 110*b* according to the fourth embodiment.

In the Peltier element 110*a*, multiple P-type semiconductors P120 and multiple N-type semiconductors N120 are alternately arranged. Electric current respectively flows through those semiconductors from heat absorbing sides (which is the side close to the condensate 80*a* in FIG. 10) to heat generating sides of the P-type semiconductors P120 and from the heat generating sides to the heat absorbing sides of the N-type semiconductors N120, so that the heat is transferred to thereby cool-down the surfaces of the liquid holding member 70, on which the layers of the condensate 80*a* is formed. In FIG. 11, reference numerals 113 and 114 respectively designate electrical terminals made of metal plates.

The heat absorbing side is formed at a cooling surface of the liquid holding member 70, while the heat generating side is formed at a heat radiating surface of the liquid holding member (70).

Modifications

The present invention should not be limited to the above embodiments, but may be modified in various manners. For example, a water-repellent coating film may be formed on the surface of the liquid holding member, the concavo-convex surface or the porous surface attached to the liquid holding member of the above embodiments.

Fifth Embodiment

Figure 12:
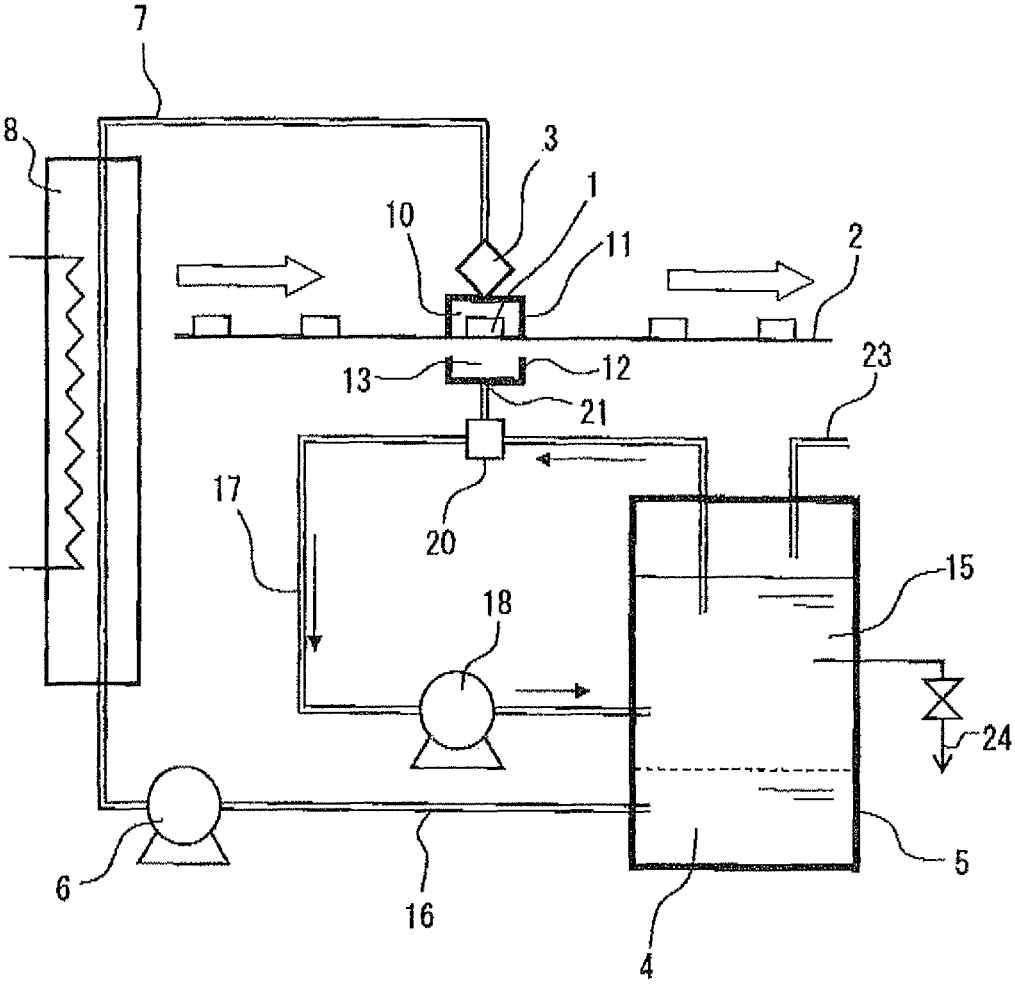
FIG. 12 is a schematic view showing a structure of a cleaning and drying apparatus according to a fifth embodiment of the present invention.

A fifth embodiment of the present invention will be explained with reference to FIGS. 12 and 13. FIG. 12 is a drawing showing a whole structure of a cleaning and drying apparatus of the fifth embodiment. In FIG. 12, the product 1, which is the product to be cleaned and to which fats and oils are adhered, is transferred by the conveyer 2 to the position at which the cleaning and drying process is carried out. At the position for the cleaning drying process, the injection nozzle 3 and the tank 5 for pooling cleaning liquid 4 are provided.

In the tank 5, the cleaning liquid 4 is pooled, a boiling point of which is remarkably changed in the atmospheric pressure and in a pressurized condition. The cleaning liquid is lyophobic to oils (insoluble in fats and oils) and selected from such liquids, as water, hydrated alcohol, fluorine compound (for example, hydrofluoric carbon (HFC), hydrofluoric ether (HFE)) and so on, wherein the boiling point thereof (saturation temperature) is higher than 40° C. in the atmospheric pressure.

The boiling point corresponds to such temperature, at which pressure of material (fluid) below a critical point becomes equal to a saturation vapor pressure of the fluid, and the boiling point is also referred to as steam point. For example, when water is heated under a predetermined constant pressure, the water temperature is increased. When the temperature reaches at a predetermined value corresponding to the pressure, the increase of the temperature is stopped and starts boiling.

The above temperature is referred to as the saturation temperature corresponding to the pressure, while the pressure is referred to as the saturation pressure corresponding to the temperature. The water of the saturation temperature is called as saturation water (boiling water), while steam vaporized from the water is called as saturated vapor. The saturated vapor causes a change of state to condensate (flocculated water) by heat radiation. The flocculated water is also referred to as condensed water or drain water.

Hydrofluoric carbon (HFC) is a sort of chlorofluorocarbon (CFC), which has been largely used as CFCs substitute, since CFC does not include Chlorine and does not destroy an ozone layer. HFC is thought to be chemical not destroying the ozone layer but having glasshouse effect.

Hydrofluoric ether (HFE) has a proper solubility and a high compatibility with various materials. HFE has been widely used as cleaning liquid, solvent, heat medium and so on. Since HFE does not include an atomic element of Chlorine, coefficient of destroying the ozone layer is zero, and HFE is safe because it does not have a firing point.

The cleaning liquid 4 is supplied from the tank 5 to the injection nozzle 3 by the liquid pump 6 (the pressurizing means) via the supply pipe 7, so that the cleaning liquid 4 is injected from the injection nozzle 3. The heat exchanger 8 is provided at the intermediate point of the supply pipe 7 as the heating device for heating the cleaning liquid to the condition of pressurized and superheated liquid the temperature of which is above the atmospheric boiling point (saturation temperature) of the cleaning liquid, or more preferably to the condition of the pressurized and superheated liquid the temperature of which is around the boiling point of the pressurized condition. The pressurized and superheated liquid is injected from the injection nozzle 3 to the product 1 to be cleaned, which is located in the atmospheric pressure, so that the cleaning and drying process is carried out at the same time.

A cleaning and drying container 11, which forms a cleaning and drying chamber 10 covering the product 1, is provided at the position for the cleaning and drying process. A vapor discharging container 12 is provided adjacent to the cleaning and drying container 11 at a downward side thereof (that is, a downstream side of the cleaning liquid 4 injected from the injection nozzle 3).

A vapor collecting opening 13 is provided in the vapor discharging container 12 for collecting the vapor of the cleaning liquid flowing out from the cleaning and drying chamber 10 and supplying the collected cleaning liquid into the tank 5. The cleaning and drying chamber 10 is so designed that a space volume of the chamber 10 is smaller than a volume of the injected cleaning liquid 4 under the atmospheric pressure.

Figure 13:
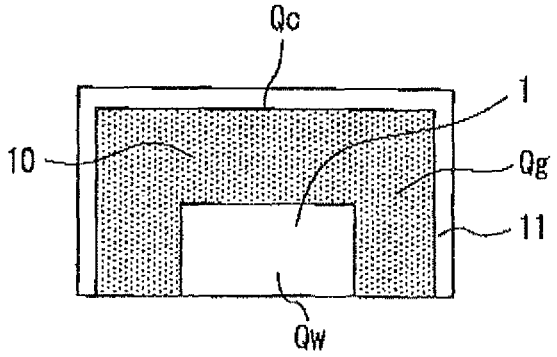
FIG. 13 is a schematic view showing a product to be cleaned and a cleaning and drying chamber.

FIG. 13 is a schematic view showing a relationship among volume "Qw" of the product 1 to be cleaned, the space volume "Qg" in the chamber 10 surrounding the product 1, and volume "Qc" of the container 11. In FIG. 13, the volume "Qc" of the container 11 corresponds to a sum of the volume "Qw" of the product 1 and the space volume "Qg" of the chamber 10 ("Qc"="Qw"+"Qg").

Therefore, the injection nozzle 3 injects the cleaning liquid 4 in the pressurized and superheated condition, the amount of which corresponds to such volume that the volume of the injected cleaning liquid in the atmospheric pressure is larger than the space volume "Qg" of the cleaning and drying chamber 10. The cleaning liquid 4 in the form of the vapor is then collected by the vapor collecting opening 13. Therefore, the volume of the cleaning liquid 4 in the form of the vapor under the atmospheric pressure, which is collected by the vapor collecting opening 13, is larger than the volume of the cleaning liquid 4 injected into the chamber 10 in the form of the vapor under the pressurized pressure.

As above, since the cleaning liquid 4 of the pressurized and superheated condition is injected such that the volume of the injected cleaning liquid 4 injected into the cleaning and drying chamber 10 in the atmospheric pressure is larger than the space volume "Qg" of the chamber 10, the cleaning effect is increased. However, the vapor of the cleaning liquid 4 may possibly flow out from the cleaning and drying chamber 10 into the air. According to the cleaning and drying apparatus of the present embodiment, however, the vapor of the cleaning liquid 4 is sucked into the tank 5 via the vapor collecting opening 13 and the volume to be sucked by the vapor collecting opening 13 is larger than that of the cleaning liquid 4 in the form of the vapor injected into the cleaning and drying chamber 10. It is, therefore, possible to suppress the possible discharge of the vapor of the cleaning liquid into the air. It is also possible to re-use the cleaning liquid.

In the tank 5, circulation liquid 15, which is oil-based liquid insoluble to the cleaning liquid 4 and has a smaller specific gravity than that of the cleaning liquid 4, is pooled. As a result, in the tank 5, a layer of the circulation liquid 15 is formed at an upper portion, while a layer of the cleaning liquid 4 is formed at a lower portion of the tank 5.

A pipe 16 for the cleaning liquid is provided at the lower portion of the tank 5, while a circulation pipe 17 is provided at the upper portion of the tank 5 so that the circulation liquid 15 is circulated through the circulation pipe 17. A circulation pump 18 is provided in the circulation pipe 17.

An ejector 20 is further provided in the circulation pipe 17 for circulating the circulation liquid 15. A suction port 21 of the ejector 20 is connected to the vapor collecting opening 13 of the vapor discharging container 12.

As is well known in the art, the ejector 20 has an inlet port (not shown) and an outlet port (not shown) in addition to the suction port 21. When the fluid flows through the ejector 20 from the inlet port to the outlet port, negative pressure is generated at the suction port 21.

Therefore, when the circulation liquid 15 of the tank 5 is circulated by the circulation pump 18, the vapor of the cleaning liquid 4 injected into the cleaning and drying chamber 10 is sucked into the ejector 20 via the vapor collecting opening 13 and the suction port 21.

Although the circulation pump 18 is provided at a downstream side of the ejector 20 in the embodiment of FIG. 12, the circulation pump 18 may be provided at an upstream side of the ejector 20 so that pressurized circulation liquid 15 may be supplied to the ejector 20.

When the vapor of the cleaning liquid 4 is sucked into the vapor collecting opening 13, the vapor of the cleaning liquid 4 injected into the cleaning and drying chamber 10, the condensate and contamination (such as, fats and oils) removed from the product 1 are transferred by the ejector 20 to the circulation pipe 17 together with the air in the cleaning and drying chamber 10. Then those vapor, the condensate and the contamination are mixed with the circulation liquid in the circulation pipe 17 and transferred into the tank 5 (to the layer of the circulation liquid 15).

The vapor of the cleaning liquid 4 is mixed with the circulation liquid 15 and collected as the cleaning liquid 4 in the tank 5. Since the circulation liquid 15 and the cleaning liquid 4 are not insoluble to each other, they are separated in the tank 5 due to the difference of the specific gravities. Namely, the cleaning liquid 4 is separated from the circulation liquid 15 and moved to the lower layer in the tank 5.

The air, which is sucked into the vapor collecting opening 13 together with the cleaning liquid 4, comes up in the tank 5 through the layer of the circulation liquid 15 and discharged into the air via an air discharge pipe 23. The contamination (such as the fats and oils) removed from the product 1 is dissolved into the circulation liquid (the oil-based liquid) and discharged out of the tank 5 together with an unnecessary portion of the circulation liquid 15 through a drain pipe 24.

An operation and advantages of the present embodiment will be explained. According to the present embodiment, the product 1 of a cylindrical shape (a diameter of 6 mm, a height of 8 mm) to be cleaned is arranged in the cleaning and drying chamber 10 of a cylindrical shape, wherein the space volume "Qg" of the cleaning and drying chamber 10 (FIG. 13) is 2 $cm^2$.

Cutting and grinding oil and fluid, which is insoluble in water (for example, oil and fluid (KZ216) insoluble in water manufactured by Yushiro Chemical Industry Co., Ltd.), is in advance applied to the product 1 (around 100 $mg/dm^2$). The cleaning liquid 4 (for example, water the boiling point of which in the atmospheric pressure is 100° C.) is pressurized by the liquid pump 6 and superheated by the heat exchanger 8 to the condition of 0.3 MPa and 130° C.

Saturated hydrocarbon (dodecane) is pooled in the tank 5 as the circulation liquid 15. The cleaning liquid 4, which is pressurized and superheated to the condition of 0.3 MPa and 130° C., is injected into the cleaning and drying chamber 10 at 0.2 liter/second for five seconds. The vapor of the cleaning liquid 4 is sucked into the suction port 21 of the ejector 20 via the vapor collecting opening 13.

As a result of the cleaning and drying process of the present embodiment, is the contamination (the fats and oils adhered to the product) can be removed to a level lower than 10 $mg/dm^2$. When the water is used as the cleaning liquid, the condensate is easily formed on the surface of the product 1 to be cleaned. However, as a result of the suction operation of the ejector 20 via the vapor collecting opening 13, it is not confirmed that the condensate remains on the surface of the product 1 after the cleaning and drying process.

Hydrophobic hydrocarbon-based material, which is insoluble in the cleaning liquid 4 and has a larger specific gravity than the cleaning liquid 4 and a carbon number of which is larger than five (5), is preferably used as the circulation liquid 15. When the hydrocarbon-based material is used, the contamination (such as the fats and oils) removed from the product are adsorbed by the circulation liquid 15 and thereby collected into the tank 5.

According to the above embodiment, the cleaning liquid 4 is pressurized and superheated such that the temperature is higher than the atmospheric boiling point. Such cleaning liquid is injected into the cleaning and drying chamber 10 of the container 11, in which the product 1 to be cleaned is arranged. The vapor discharging container 12 is provided adjacent to the cleaning and drying container 11 so that the vapor collecting opening 13 is communicated to the cleaning and drying chamber 10.

The suction port 21 of the ejector 20, through which the circulation liquid 15 passes, is connected to the vapor collecting opening 13 in order that the vapor of the cleaning liquid injected into the cleaning and drying chamber 10 is sucked from the vapor collecting opening 13. Thus, the cleaning liquid 4 is collected and re-used.

According to the above embodiment, since the vapor of the cleaning liquid 4 is hardly condensed on the surface of the product 1 to be cleaned and the condensate is not likely to be formed, effect for removing the fats and oils is not decreased. In addition, since the cleaning liquid 4 does not remain on the surface of the product, the insufficient drying process can be avoided.

Even when the global warming material (e.g. Hydrofluoric carbon (HFC)) may be used as the cleaning liquid 4, since the vapor of the cleaning liquid is sucked from the vapor collecting opening 13 and the collected vapor is returned to the tank 5 so as to re-use it, the global warming material is not discharged into the air.

Sixth Embodiment

Figure 14:
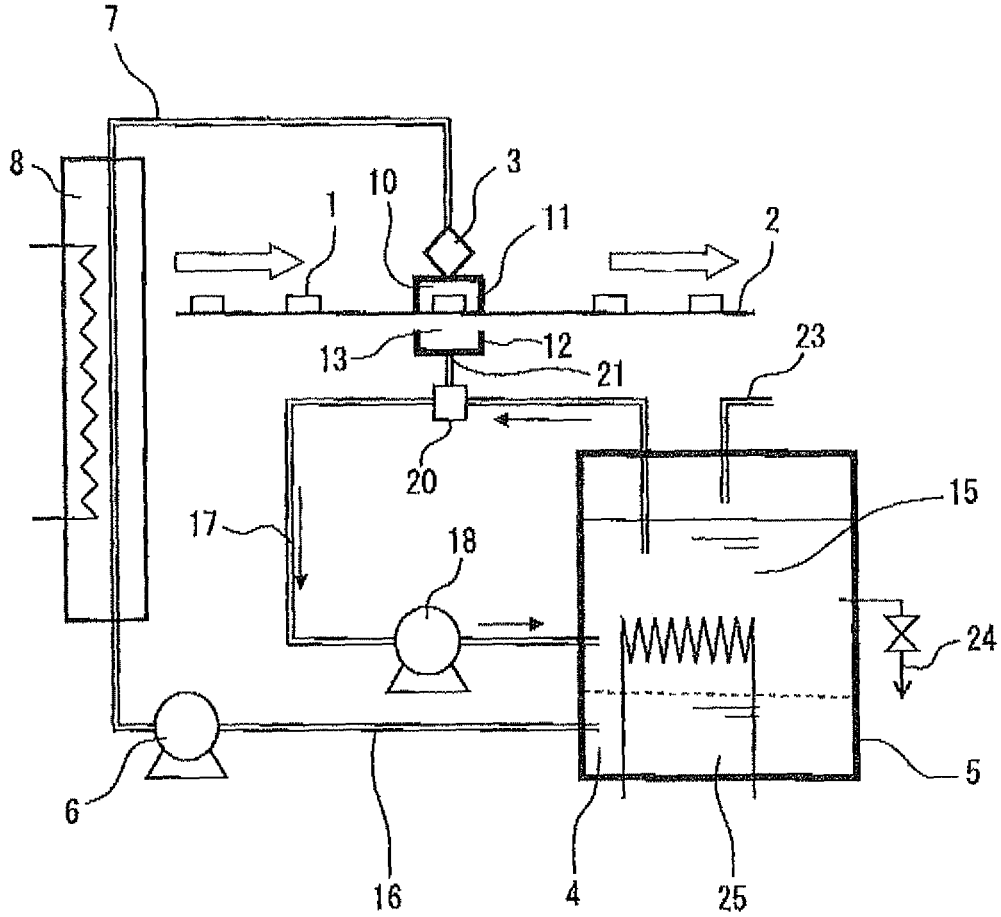
FIG. 14 is a schematic view showing a structure of a cleaning and drying apparatus according to a sixth embodiment of the present invention.
Figure 15:
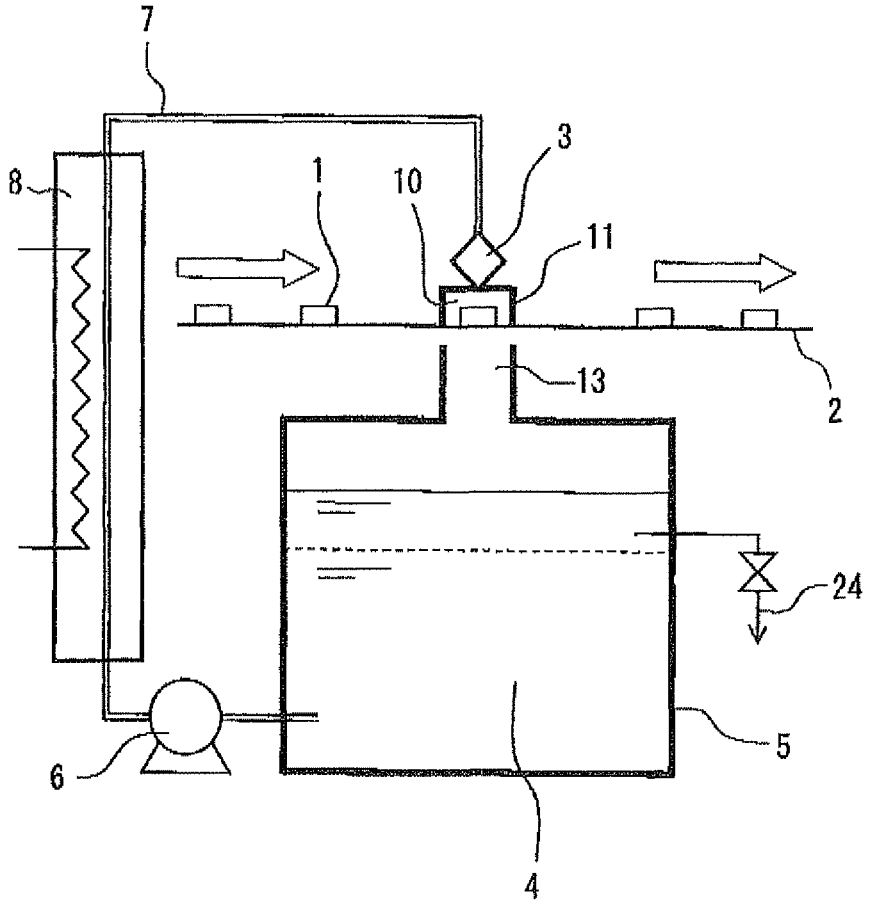
FIG. 15 RELATED ART
FIG. 15 is a schematic view showing a structure of a cleaning and drying apparatus of a related art (an apparatus according to a prior application of the inventor of the present invention (Application No. 2010-094897)).

A sixth embodiment will be explained. FIG. 14 is a schematic view showing the cleaning and drying apparatus of the sixth embodiment. In FIG. 14, a reference numeral 25 designates a heat exchanger for cooling down the circulation liquid 15 in the tank 5.

The circulation liquid 15 is cooled down by the heat exchanger 25 at a temperature lower than an ambient temperature, or more preferably at a temperature lower than 10° C. When such cooled down circulation liquid is circulated by the circulation pump 18 through the circulation pipe 17, it is possible not only to effectively condense and thereby collect the cleaning liquid sucked from the vapor collecting opening 13 but also effectively separate the cleaning liquid 4 from the circulation liquid 15 in the tank 5. The heat exchanger 25 may be provided at an intermediate portion of the circulation pipe 17 to cool down the circulation liquid 15.

What is claimed is:

1. A cleaning and drying method, comprising:

pressurizing and superheating a cleaning liquid using a pressurizing and superheating device to a temperature that is higher than an atmospheric boiling point of the cleaning liquid, the cleaning liquid being lyophobic to oil;

injecting the pressurized and superheated cleaning liquid into a cleaning and drying chamber of a cleaning and drying container so that a product arranged in the cleaning and drying chamber is cleaned and dried, the injected cleaning liquid being changed to vapor when injected;

circulating a circulation liquid by a circulation pump through a circulation pipe in order to generate a negative pressure at a suction port of a suction device, the circulation liquid being insoluble to the cleaning liquid and having a smaller specific gravity than that of the cleaning liquid;

sucking the vapor of the cleaning liquid into the suction port of the suction device via a vapor discharging container having a vapor collecting opening;

collecting the vapor of the cleaning liquid together with the circulation liquid through the circulation pipe;

separating the cleaning liquid from the circulation liquid in a tank; and re-using the cleaning liquid that is separated from the circulation liquid, wherein the cleaning and drying method is performed in a cleaning and drying apparatus comprising:

the tank, which pools the cleaning liquid and the circulation liquid;

the cleaning and drying container including the cleaning and drying chamber for arranging the product therein;

a cleaning-liquid pipe provided between the cleaning and drying container and a lower portion of the tank;

the pressurizing and superheating device, which is provided in the cleaning-liquid pipe, for pressurizing and superheating a part of the cleaning liquid from the tank to the temperature that is higher than the atmospheric boiling of the cleaning liquid;

an injection device provided in the cleaning and drying container for injecting the pressurized and superheated cleaning liquid toward the product arranged in the cleaning and drying chamber of the cleaning and drying container;

the vapor discharging container, which is provided adjacent to the cleaning and drying container and has the vapor collecting opening that communicates with the cleaning and drying chamber;

the circulation pipe, which is provided between an upper portion of the tank and another portion of the tank;

the circulation pump, which is provided in the circulation pipe so that a part of the circulation liquid is sucked from the upper portion of the tank and returns to the tank via the circulation pipe; and the suction device, which is provided in the circulation pipe and has the suction port connected to the vapor discharging container for sucking the vapor of the cleaning liquid injected into the cleaning and drying chamber via the suction port in order to collect the cleaning liquid and then return the cleaning liquid into the tank.

2. The cleaning and drying method according to claim 1, wherein the suction device has an inlet port and an outlet port in addition to the suction port, wherein the negative pressure is generated at the suction port when the circulation liquid flows from the inlet port toward the outlet port.

3. The cleaning and drying method according to the claim 1, wherein in the injecting step, when the pressurized and superheated cleaning liquid is injected into the cleaning and drying chamber, a volume of the injected cleaning liquid under an atmospheric pressure is larger than a space volume of the cleaning and drying chamber, the space volume being equal to a volume of the product subtracted from a total volume of the cleaning and drying chamber, and in the sucking step, a volume to be sucked from the suction port is larger than a volume of the vapor injected into the cleaning and drying chamber in the pressurized and superheated condition.

4. The cleaning and drying method according to the claim claim 1, wherein in the injecting step, a part of the cleaning liquid pooled in the tank is pressurized and superheated, in the circulating step, the circulation liquid flows through the suction device from an inlet port to an outlet port thereof so that the negative pressure is generated at the suction port, wherein the circulation liquid is circulated by the circulation pump in a circuit from the tank and back to the tank through the suction device, and in the collecting step, the vapor of the cleaning liquid sucked from the suction port is collected into the tank together with the circulation liquid.

5. A cleaning and drying method, comprising:

pressurizing and superheating a part of a cleaning liquid that is pooled in a tank to a temperature that is higher than an atmospheric boiling point of the cleaning liquid;

injecting the pressurized and superheated cleaning liquid into a cleaning and drying chamber of a cleaning and drying container in which a product to be cleaned is arranged, the injected cleaning liquid being changed to a vapor when injected;

sucking the vapor of the cleaning liquid into a suction port of a suction device via a vapor discharging container that is provided adjacent to the cleaning and drying container and that has a vapor collecting opening, the suction device having an inlet port and an outlet port in addition to the suction port, so that a circulation liquid flows through the suction device from the inlet port to the outlet port and a negative pressure is generated at the suction port;

further sucking the vapor of the cleaning liquid from the suction port to collect the vapor of the cleaning liquid together with the circulation liquid in the tank;

circulating the circulation liquid by a circulation pump in a circuit from the tank and back to the tank through the suction device, wherein the circulation liquid is cooled down by a heat exchanger; and re-using the vapor of the cleaning liquid that is sucked into the suction port and collected as the cleaning liquid.

6. The cleaning and drying method according to the claim 5, wherein the heat exchanger is provided in the tank for cooling down the circulation liquid.

7. The cleaning and drying method according to claim 5, wherein in the injecting step, when the pressurized and superheated cleaning liquid is injected into the cleaning and drying chamber, a volume of the injected cleaning liquid under an atmospheric pressure is larger than a space volume of the cleaning and drying chamber, the space volume being equal to a volume of the product subtracted from a total volume of the cleaning and drying chamber, and in the sucking step, a volume to be sucked from the suction port is larger than a volume of the vapor injected into the cleaning and drying chamber in the pressurized and superheated condition.

* * * * *